US009353530B2

(12) United States Patent
Sawada

(10) Patent No.: US 9,353,530 B2
(45) Date of Patent: May 31, 2016

(54) OUTER WALL MOUNTING MEMBER AND OUTER WALL STRUCTURE

(71) Applicant: Nichiha Corporation, Nagoya-shi, Aichi (JP)

(72) Inventor: Koji Sawada, Nagoya (JP)

(73) Assignee: NICHIHA CORPORATION, Nagoya-Shi (JP)

( * ) Notice: Subject to any disclaimer, the term of this patent is extended or adjusted under 35 U.S.C. 154(b) by 0 days.

(21) Appl. No.: 14/668,323

(22) Filed: Mar. 25, 2015

(65) Prior Publication Data

US 2016/0040433 A1 Feb. 11, 2016

(30) Foreign Application Priority Data

Aug. 8, 2014 (JP) ..... 2014-162988

(51) Int. Cl.

| | |
|---|---|
| ***E04F 13/08*** | (2006.01) |
| ***E04B 2/88*** | (2006.01) |
| ***E04B 1/41*** | (2006.01) |
| *E04B 1/38* | (2006.01) |

(52) U.S. Cl.

CPC ..... *E04F 13/085* (2013.01); *E04B 1/40* (2013.01); *E04B 2001/405* (2013.01); *E04F 13/0826* (2013.01)

(58) Field of Classification Search

CPC ..... E04F 13/0826; E04F 13/0846; E04F 13/0803; E04F 13/0808; E04F 13/081; E04F 13/0816; E04F 13/0814; E04F 13/0889; E04F 13/12; E04F 13/0801; E04F 13/083; E04B 2/90; E06B 3/5427

USPC ..... 52/58, 60, 61, 62, 235, 367, 392, 489.1, 52/489.2, 511, 506.06, 512, 506.05, 509, 52/513

See application file for complete search history.

(56) References Cited

U.S. PATENT DOCUMENTS 3,295,282 A * 1/1967 Belcher, Jr. ..... 52/460
4,060,951 A * 12/1977 Gere ..... 52/508

(Continued)

FOREIGN PATENT DOCUMENTS

| | | | |
|---|---|---|---|
| JP | 2009-41181 | A | 2/2009 |
| JP | 2009-41181 | A5 | 6/2010 |
| JP | 2012-1967 | A | 1/2012 |

OTHER PUBLICATIONS

U.S. Office Action for U.S. Appl. No. 14/668,387, dated Jun. 5, 2015.

*Primary Examiner* — Joshua J Michener
*Assistant Examiner* — Kyle Walraed-Sullivan
(74) *Attorney, Agent, or Firm* — Birch, Stewart, Kolasch & Birch, LLP

(57) ABSTRACT

An outer wall structure of the invention includes an outer wall mounting member composed of a supporting plate and a plurality of securing members. The supporting plate includes a plate body and a positioning portion. With this outer wall structure, the plate body is fixed to a horizontal furring strip member and a frame member in an upside portion and a downside portion of a sash body of a window sash at a second distance away from an outer surface of the sash body. The securing members are fixed to the plate body at a third distance away from the outer surface of the sash body. In this outer wall structure, the position at the second distance is farther away from the outer face than the position at a distance from the outer surface of the sash body to a distal end portion of a flange of the sash body.

20 Claims, 7 Drawing Sheets

(56) References Cited

U.S. PATENT DOCUMENTS

| | | | | | |
|---|---|---|---|---|---|
| 4,307,551 | A * | 12/1981 | Crandell | 52/235 |
| 4,483,122 | A * | 11/1984 | Crandell | 52/747.1 |
| 4,553,366 | A * | 11/1985 | Guerin | 52/506.08 |
| 5,077,947 | A * | 1/1992 | Takeda | 52/235 |
| 5,158,392 | A * | 10/1992 | Takeda | 52/235 |
| 5,239,798 | A * | 8/1993 | Saito | 52/235 |
| 5,544,461 | A * | 8/1996 | Sommerstein | 52/235 |
| 5,709,056 | A * | 1/1998 | Matsuyama et al. | 52/235 |
| 5,953,865 | A * | 9/1999 | Rickards | 52/139 |
| 6,745,527 | B1 * | 6/2004 | Sherman et al. | 52/235 |
| 6,748,709 | B1 * | 6/2004 | Sherman et al. | 52/235 |
| 8,051,623 | B2 | 11/2011 | Loyd | |
| 8,127,507 | B1 * | 3/2012 | Bilge | 52/235 |
| 2001/0045075 | A1 * | 11/2001 | Watanabe | 52/712 |
| 2002/0032999 | A1 * | 3/2002 | Ito | 52/474 |
| 2009/0272055 | A1 * | 11/2009 | Griffiths | 52/309.3 |
| 2010/0170173 | A1 * | 7/2010 | Boyer et al. | 52/235 |
| 2012/0241574 | A1 * | 9/2012 | Uota et al. | 248/231.81 |

* cited by examiner

OUTER WALL MOUNTING MEMBER AND OUTER WALL STRUCTURE

CROSS REFERENCE TO RELATED APPLICATIONS

This application is based on Japanese Patent Application No. 2014-162988 filed with the Japanese Patent Office on Aug. 8, 2014, the entire content of which is hereby incorporated by reference.

BACKGROUND OF THE INVENTION

1. Field of the Invention

The present invention relates to an outer wall mounting member and an outer wall structure.

2. Description of the Related Art

An outer wall structure for mounting an exterior building material (e.g., a ceramic exterior building material) to a building body formed by a plurality of column members, furring strip members and the like, is known to be used, for example, for wooden buildings such as houses. Conventionally, a configuration in which the exterior building material is directly fixed to the building body by nailing or screwing has been used to mount the exterior building material onto the building body. However, with the outer wall structure for which nailing or the like is used, there is a concern that the exterior building material may be damaged during mounting. In addition, the head of the nail or the like used for mounting may be exposed on the exterior side, resulting in an impairment of the aesthetic appearance of the building.

For this reason, a securing member disclosed in, for example, JP 2009-41181A may be used for such an outer wall structure. The securing member is provided with a securing portion capable of securing the exterior building material to the building body. The securing member is fixed to the building body by being screwed to the building body. Then, as a result of the exterior building material being secured to the securing portion, the exterior building material is fixed to the building body via the securing member. This makes it possible to mount the exterior building material onto the building body, while preventing damage of the exterior building material and deterioration in the aesthetic appearance.

Meanwhile, an opening portion is formed in the building body at a location where a window, an entrance or the like is disposed, and the opening portion is generally provided with an opening member such as a window sash. The opening member includes an opening member body having a frame form, and a flange extending outward substantially at a right angle from the outer surface of the opening member body. Then, the opening member is fixed to the opening portion by the flange being fixed on the exterior side of the building body. After that, a furring strip member made of a wood, for example, is fixed on the flange of the opening member for securing the exterior building material on the outside of the building body.

SUMMARY OF THE INVENTION

In order to fix the above-described conventional securing member to the building body in the upside portion and the down side portion of the opening member, it is conceivable to make a hole in the furring strip member with the flange in order to screw the securing member to the building body through the furring strip member and the flange. However, with this configuration, rainwater or the like may enter the interior side of the building body from the hole formed in the flange, thus causing a reduction in the waterproofness of the building.

On the other hand, when a short screw that does not reach the flange and the building body is used to fax the securing member to the furring strip member to maintain the waterproofness of the building, it is likely that the securing member may not be fully fixed to the building body, thus posing a concern that the exterior building material may become unstable after mounted onto the building body. Moreover, if the securing member is fixed to a thick furring strip member having an enough length from the flange, the gap between the exterior building material and the opening member body is increased after the exterior building material is secured to the securing member, resulting in deterioration in the aesthetic appearance of the building.

Because of these factors, instead of using the above-described securing member to mount the exterior building material onto the building body in the upside portion and the down side portion of the opening member, and the exterior building material is directly fixed to the building body by nailing or screwing. Therefore, the nail head or screw head appears in the outer surface of the exterior building material to cause the deterioration in the aesthetic appearance around the opening member.

The present invention has been made in view of the above-described conventional circumstances. It is an object of the invention to provide an outer wall mounting member and an outer wall structure that enable the exterior building material to be mounted onto the building body, while maintaining the waterproofness of the building, and preventing the deterioration in the aesthetic appearance of the building around the opening member.

According to an aspect of the present invention, an outer wall mounting member for mounting an exterior building material onto a building body has an opening member fixed in the building body through a flange extending from an outer surface of the opening member. The outer wall mounting member includes: a supporting plate capable of being contacted with the outer surface of the opening member, including a plate body to fix the supporting plate to the building body by a supporting-plate-fitting at a supporting-plate-fixing-position where the supporting-plate-fitting does not contact with the flange, and a securing member configured to be fixed to the supporting plate, including a securing portion to engage the exterior building material.

DESCRIPTION OF THE PREFERRED EMBODIMENTS

Figure 1:
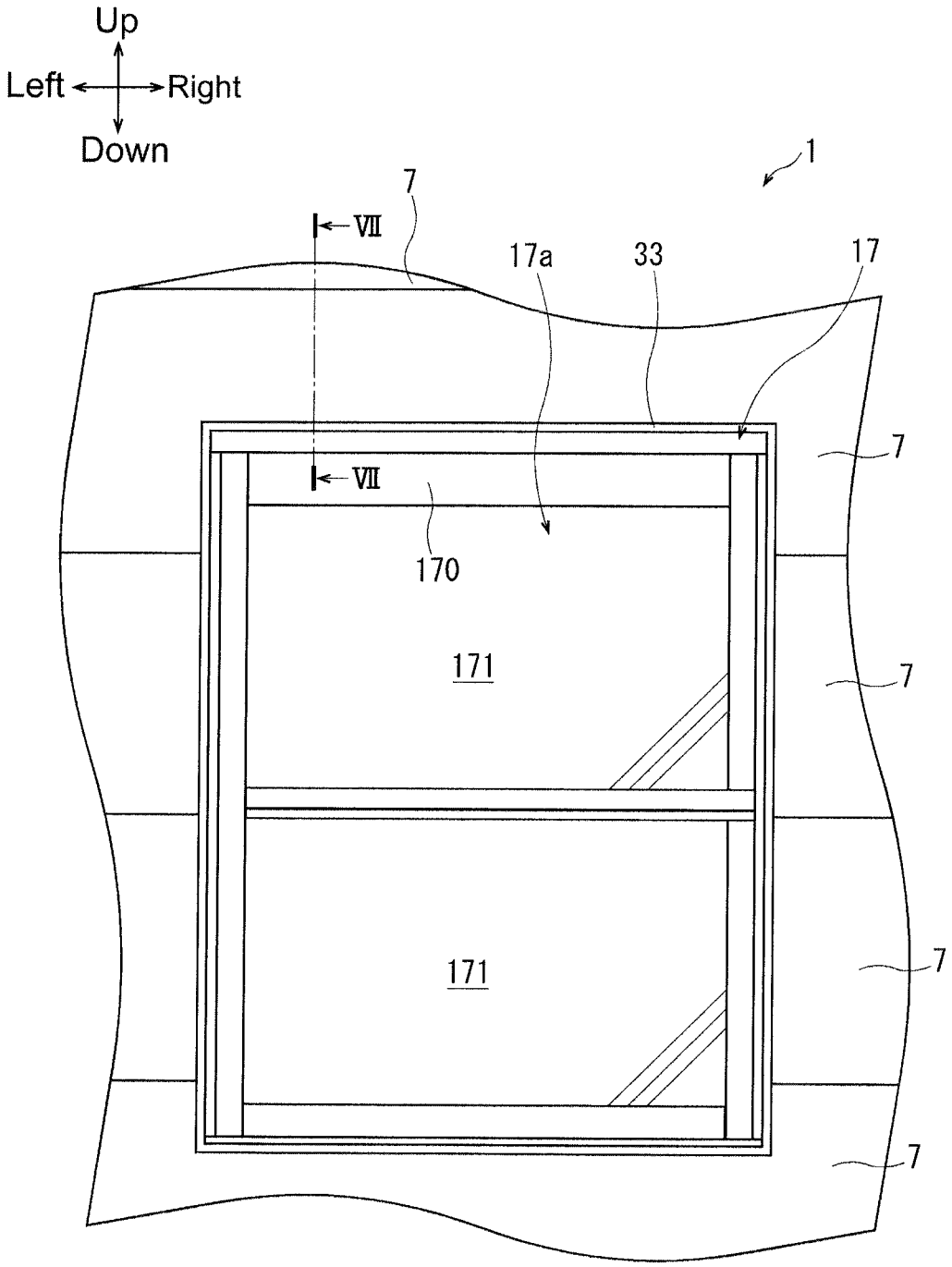
FIG. 1 is a partial front view showing a part of a building for which an outer wall structure according to an embodiment is used.

An outer wall mounting member is for mounting a ceramic exterior building material onto a building body in at least one of an upside and a downside of an opening member provided in an opening portion formed in the building body. The opening member includes: an opening member body that has a frame form; and a flange that extends outward at a substantially right angle from an outer surface of the opening member body to be fixed on an exterior side of the building body at a position with a first distance (i.e., a flange-fixing-position) away from the opening member body. An engaging groove is formed in an end face of the exterior building material. The outer wall mounting member includes a supporting plate and a securing member. The supporting plate having a plate form, is to be fixed to the building body in at least one of the upside portion and the downside portion of the opening member body by means of a nail or a screw (i.e., a supporting-plate-fitting) at a position with a second distance (i.e., a supporting-plate-fixing-position) away from the opening member body. The supporting plate is to be provided between the building body and the exterior building material. The securing member is to be fixed to the supporting plate at a third distance away from the opening member body, and includes a securing portion capable of securing the exterior building material by being inserted into the engaging groove. A position with the second distance is farther away from the opening member body than the position with a distance from the opening member body to a distal end portion of the flange. A position with the third distance (i.e., a securing-member-fixing-position) is closer to the opening member body than the position with the distance from the opening member body to the distal end portion of the flange.

In the outer wall mounting member, the securing member is fixed to the supporting plate. Thus, when the supporting plate is fixed to the building body by means of a nail or a screw at the second distance away from the opening member body, it is possible to provide the securing member in at least one of the upside portion and the downside portion of the opening member body, without directly fixing the securing member to the building body. Then, it is possible to mount the exterior building material onto the building body by securing the exterior building material to the securing portion with inserting the securing portion of the securing member into the engaging groove of the exterior building material.

Here, the position with the second distance is farther away from the opening member body than the position with the distance from the opening member body to the distal end portion of the flange. Thus, in the outer wall mounting member, the supporting plate is fixed to the building body at a position different from the position of the flange, in other words, at a position where the flange is not present. Consequently, with the outer wall mounting member, it is not necessary to form a hole in the flange to fix the supporting plate to the building body by means of a nail or a screw, and thus, the reduction of the waterproofness of the building is prevented.

Since the supporting plate is fixed to the building body at a position where the flange is not present in this way, the outer wall mounting member enables the supporting plate to be firmly fixed to the building body. Moreover, with the outer wall mounting member, the securing member is fixed to the supporting plate, and it is thus possible to fix the securing member to the supporting plate in a favorable manner, without being affected by the presence of the flange. As a result of these points, the outer wall mounting member enables the exterior building material to be stably mounted onto the building body.

Also, the securing member is fixed to the supporting plate at the third distance away from the opening member body. The position with the third distance is closer to the opening member body than the position with the distance from the opening member body to the distal end portion of the flange. Thus, with the outer wall mounting member, the securing member is provided close to the opening member body in at least one of the upside portion and the down side portion of the opening member body. Consequently, the outer wall mounting member can reduce the interval between the exterior building material and the opening member body when the exterior building material is secured to the securing portion.

Thus, with the outer wall mounting member, it is also possible to mount the exterior building material onto the building body by nailing or screwing in at least one of the upside portion and the down side portion of the opening member, without directly fixing the exterior building material to the building body.

Therefore, with the outer wall mounting member, it is possible to mount the exterior building material onto the building body, while maintaining the waterproofness of the building, and preventing the deterioration in the aesthetic appearance of the building in at least one of the upside portion and the downside portion of the opening member.

In particular, in the outer wall mounting member, the securing portion engages the exterior building material by being inserted into the engaging groove formed in the exterior building material. Thus, the outer wall mounting member enables the securing portion to favorably secure the exterior building material while preventing the warping of the exterior building material over time, without another means for joining the exterior building material to the securing member, e.g., bonding or the like.

In the outer wall mounting member, the securing member is fixed to the supporting plate in a state in which the end face of the exterior building material is secured to the securing portion. Alternatively, the exterior building material can be secured to the securing portion through the end face of the exterior building material after the securing member has been fixed to the supporting plate.

In the outer wall mounting member, the building body is composed of furring strip members, branderings and the like, in addition to frame members such as a through column, a stand column, a stud, a window sill, and a lintel. These frame members, furring strip members and the like are made of wood or other materials.

Examples of the opening member include a door and the like provided at the entrance of a building, in addition to a window sash provided at a window of the building. The opening member body includes a member or a device capable of opening and closing the window, the entrance, or the like.

The securing member is fixed to the supporting plate by a nail, a screw, or the like (i.e., a securing-member-fitting).

In the outer wall mounting member, the position with the first distance is farther away from the opening member body than the position with the third distance being from the opening member body. Conversely, the position with the first distance can be closer to the opening member body than the position with the third distance being from the opening member body. Alternatively, the first distance and the third distance can be equally distant from the opening member body.

In the outer wall mounting member, it is preferable that the supporting plate includes a plate body and a positioning portion. The plate body has a plate form to be fixed to the building body, and to which the securing member is fixed. The positioning portion is provided in the plate body and performs positioning relative to the opening member body.

In this case, the positioning of the supporting plate relative to the opening member body and the building body is facilitated. Thus, the outer wall mounting member enables the plate body to be easily fixed to the building body.

The plate body is made of, for example, a metal plate formed to have a flat surface. In addition, the plate body is made of, for example, a metal plate formed to have a plurality of punched holes in its surface, or a metallic material formed to have a grid configuration.

The positioning portion is an individual part that can be separated from the plate body or a part formed integrally with the plate body. In case of the integral part, it is particularly preferable that the positioning portion is easily formed integrally with the plate body by bending a plate.

According to another embodiment, an outer wall structure has a ceramic exterior building material mounted onto a building body in at least one of an upside portion and a downside portion of an opening member by using an outer wall mounting member. The opening member is provided in an opening portion formed in the building body. The opening member includes: an opening member body that has a frame form; and a flange that extends outward at a substantially right angle from an outer surface of the opening member body to be fixed to an exterior side of the building body at a position with a first distance (i.e., a flange-fixing-position) away from the opening member body. An engaging groove is formed in an end face of the exterior building material. The outer wall mounting member includes a supporting plate and a securing member. The supporting plate having a plate form, is fixed to the building body in at least one of an upside portion and a downside portion of the opening member body by means of a nail or a screw (i.e., a supporting-plate-fitting) at a position with a second distance away from the opening member body, and is provided between the building body and the exterior building material. The securing member is to be fixed to the supporting plate at a position with a third distance (i.e., a securing-member-fixing-position) away from the opening member body, and includes a securing portion capable of securing the exterior building material by being inserted into the engaging groove. The position with the second distance is farther away from the opening member body than a distance from the opening member body to an distal end portion of the flange. The position with the third distance is closer to the opening member body than the distance from the opening member body to the distal end portion of the flange.

In the outer wall structure, the outer wall mounting member having the above-described features is used. Thus, with this outer wall structure, it is also possible to mount the exterior building material onto the building body by nailing or screwing in at least one of an upside portion and a downside portion of the opening member without directly fixing the exterior building material to the building body.

Therefore, with the outer wall structure, it is possible to mount the exterior building material onto the building body, while maintaining the waterproofness of the building, and preventing the deterioration in the aesthetic appearance of the building in at least one of the upside portion and the downside portion of the opening member.

With the outer wall mounting member, it is possible to mount the exterior building material onto the building body, while maintaining the waterproofness of the building, and preventing the deterioration in the aesthetic appearance of the building around the opening member. Furthermore, with the outer wall structure, it is possible to mount the exterior building material onto the building body, while maintaining the waterproofness of the building, and preventing the deterioration in the aesthetic appearance of the building around the opening member.

In the following, an embodiment of the present invention will be described with reference to the drawings.

An outer wall structure according to an embodiment is used for a building 1 such as a house shown in FIG. 1. The outer wall structure includes a pair of outer wall mounting members 3 shown in FIG. 2, and the outer wall mounting members 3 are used to mount an exterior building material 7 shown in FIG. 1 onto a building body 5. For example, the exterior building material 7 is made from a ceramic. Note that it is possible to use, for example, "Moen Excelard (Japanese Registered Trademark)" manufactured by NICHIHA CORPORATION as the exterior building material 7.

Figure 2:
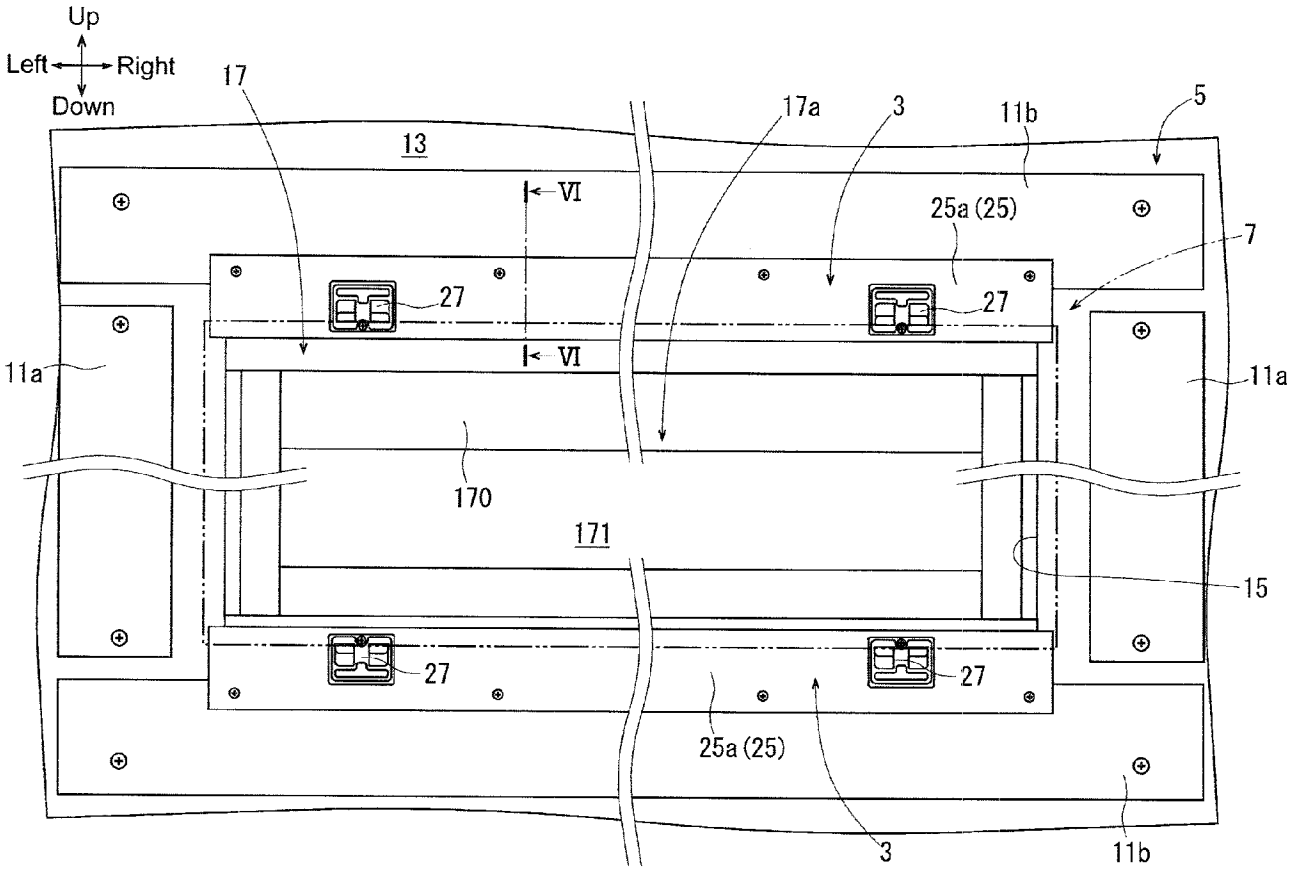
FIG. 2 is a partial front view of an area surrounding a window sash according to the outer wall structure of an embodiment.
Figure 3:
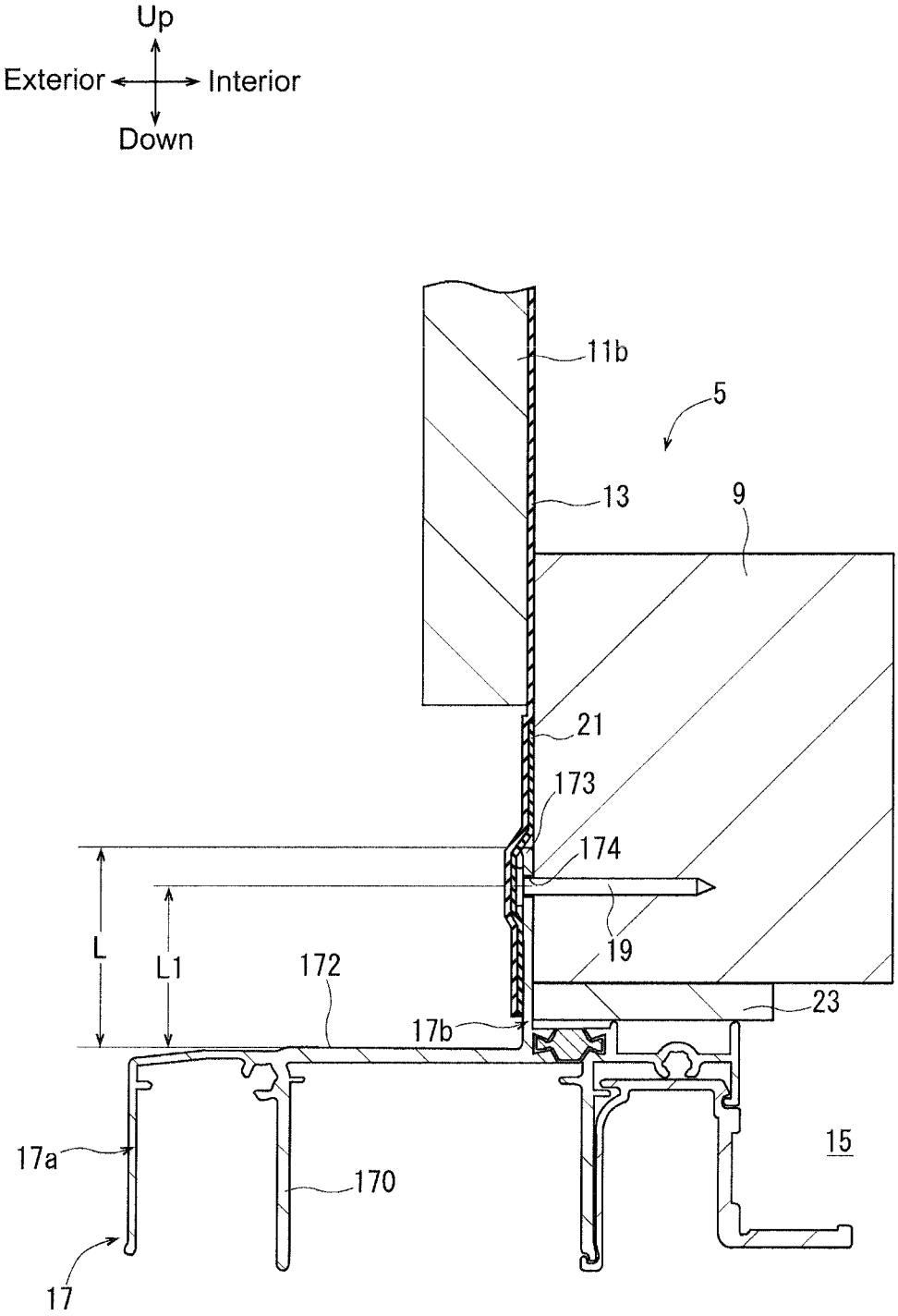
FIG. 3 is a an enlarged cross-sectional view of a principal part showing a state in which the window sash has been mounted onto a building body according to the outer wall structure of an embodiment.
Figure 6:
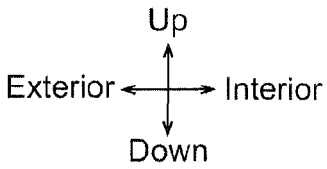
FIG. 6 is an enlarged cross-sectional view looking in the direction of arrows VI-VI in FIG. 2 according to the outer wall structure of an embodiment.
Figure 6:
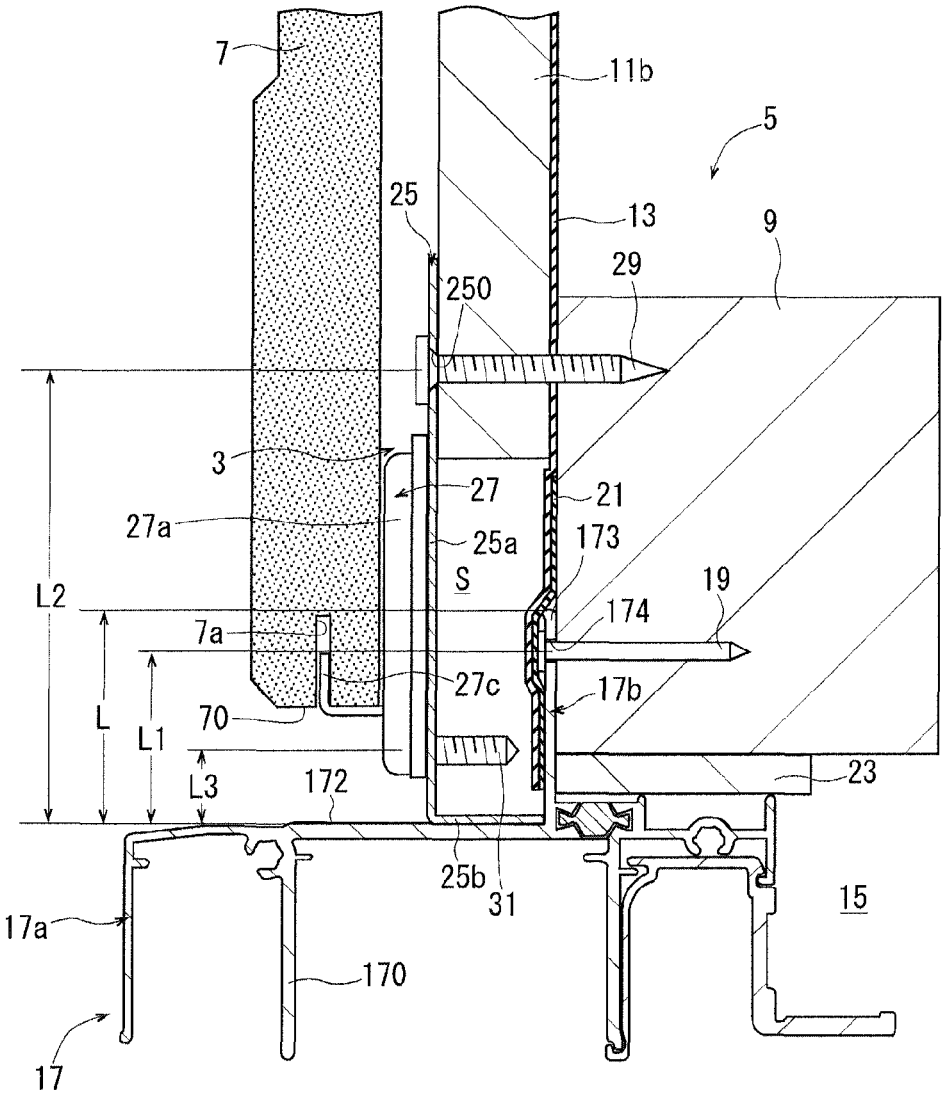
Figure 7:
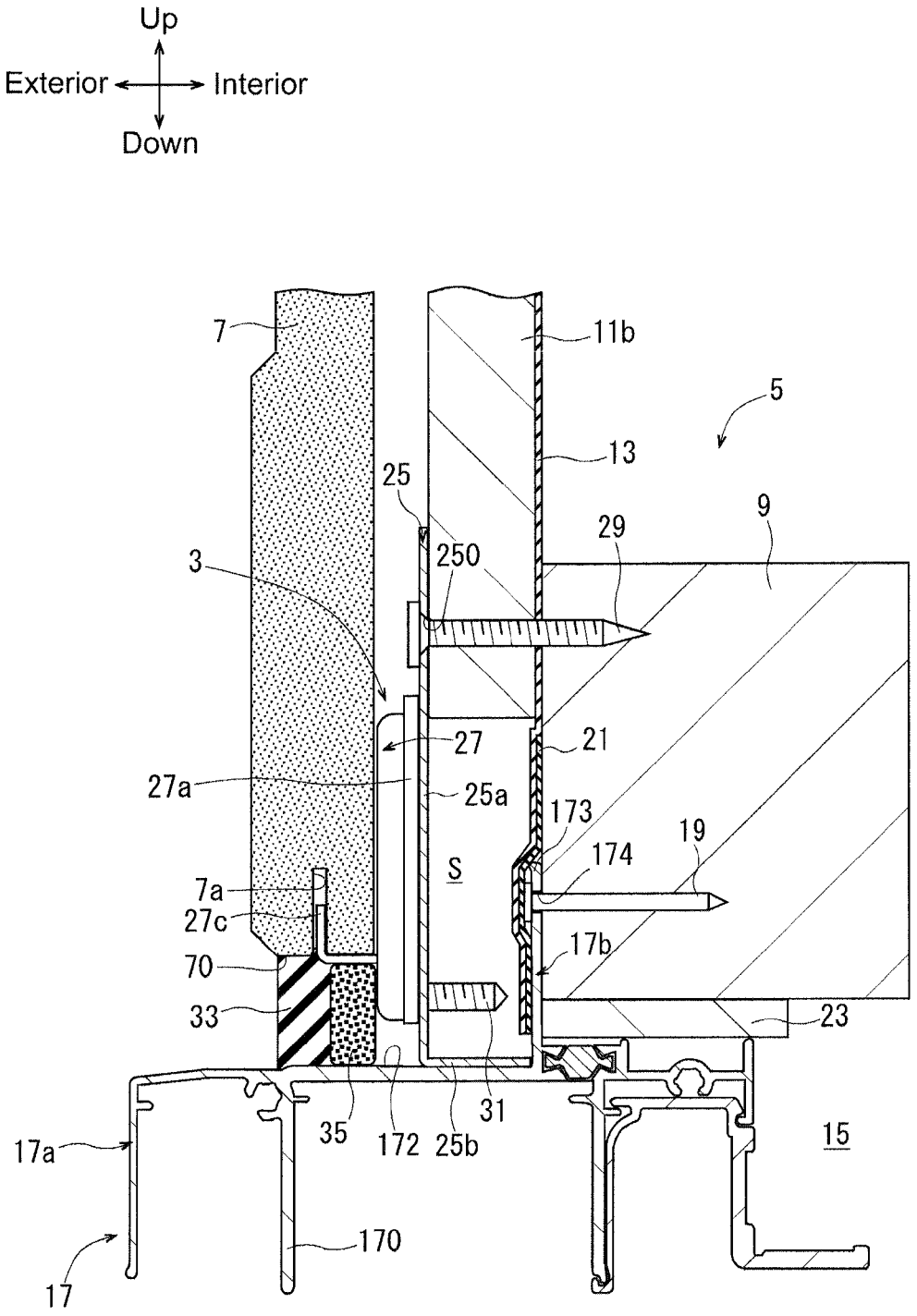
FIG. 7 is an enlarged cross-sectional view looking in the direction of arrows VII-VII in FIG. 1 according to the outer wall structure of an embodiment.

The building 1 is, for example, a wooden building, and the building body 5 is formed by assembling a frame member 9 shown in FIG. 3 as well as a plurality of vertical furring strip members 11*a*, a plurality of horizontal furring strip members 11*b* and the like shown in FIG. 2 by a known construction technique. A waterproof sheet 13 (i.e., a waterproof material) is provided between the frame members 9 and the vertical and horizontal furring strip members 11*a*, 11*b*. Note that in order to simplify the description, the exterior building material 7 is depicted by two-dot chain lines in FIG. 2 and the illustration of a caulking compound 33 and the like, which will be described later, has been omitted. Additionally, a plurality of frame members 9 are provided, and only one of the frame members 9 is shown in FIG. 3 and FIGS. 6 and 7, which will be described later.

In the building body 5, the plurality of frame members 9 are assembled into a frame, thus forming a rectangular opening portion 15 as shown in FIG. 2. The vertical furring strip members 11*a* are fixed to the frame member 9 on the right side and the left side of the opening portion 15 in FIG. 2. On the other hand, the horizontal furring strip members 11*b* are fixed to the frame member 9 in an upside portion and a downside portion of the opening portion 15 in FIG. 2. Consequently, the opening portion 15 is surrounded by the vertical furring strip members 11*a* and the horizontal furring strip members 11*b*. The opening portion 15 is provided with a window sash 17 shown in FIG. 1. The window sash 17 corresponds to an opening member.

The window sash 17 is in common use, and includes a sash body 17*a* and a flange 17*b* shown in FIG. 3. The sash body 17*a* corresponds to an opening member body. As shown in FIG. 1, the sash body 17*a* includes a plurality of frames 170 made of an aluminum alloy and a plurality of sheets of window glass 171 fitted into the frame 170. Consequently, the sash body 17*a* has the form of a rectangular frame.

As shown in FIG. 3, the flange 17*b* is provided integrally with the sash body 17*a*, and extends outwardly at a substantially right angle from an outer surface 172 of the sash body 17*a*. More specifically, the flange 17*b* is sized to have a length L, and extends outward along the length L at a substantially right angle from the outer surface 172 of the sash body 17*a*. Consequently, the distance from the outer surface 172 of the sash body 17*a* to the distal end portion 173 of the flange 17*b* is a distance L (i.e., a flange-length).

Additionally, a plurality of mounting holes 174 are formed in the flange 17*b*. Each of the mounting holes 174 is formed in the flange 17*b* at a position with a first distance L1 (i.e., a flange-fixing-position) away from the sash body 17*a*, more specifically, the outer surface 172 of the sash body 17*a*.

The outer wall structure is installed by performing the following steps.

First, an opening member mounting step is performed in which the window sash 17 is provided to the building body 5. Specifically, the flange 17*b* is brought into contact with the exterior side of the frame member 9, with the sash body 17*a* set within the opening portion 15. In this state, a nail 19 is inserted through each of the mounting holes 174, and the nails 19 are driven into the frame member 9 from the exterior side of the building body 5, thus fixing the flange 17*b* on the exterior side of the frame member 9. Here, as described above, each of the mounting holes 174 is formed in the flange 17*b* at a position away from the outer surface 172 of the sash body 17*a* by a first distance L1. Thus, the flange 17*b* is fixed on the exterior side of the frame member 9, in other words, the exterior side of the building body 5 at a position away from the outer surface 172 of the sash body 17*a* by the first distance L1. After the flange 17*b* has been fixed to the frame member 9, a waterproof tape 21 (i.e., a waterproof material) is attached to the frame member 9 and the flange 17*b*. Additionally, the above-described waterproof sheet 13 covers the exterior side of the waterproof tape 21. As a result of these, waterproof treatment between the frame member 9 and the flange 17*b* is provided.

Although not shown in the drawings, a plurality of other mounting holes are formed in the sash body 17*a* in addition to the flange 17*b*, and the sash body 17*a* is fixed to the frame member 9 also by means of mounting screws inserted through the mounting holes. Note that to provide the window sash 17 to the building body 5, a spacer member 23 is provided as appropriate between the frame member 9 and the sash body 17*a*. In this way, the window sash 17 is provided to the building body 5, thus completing the opening member mounting step.

Figure 4:
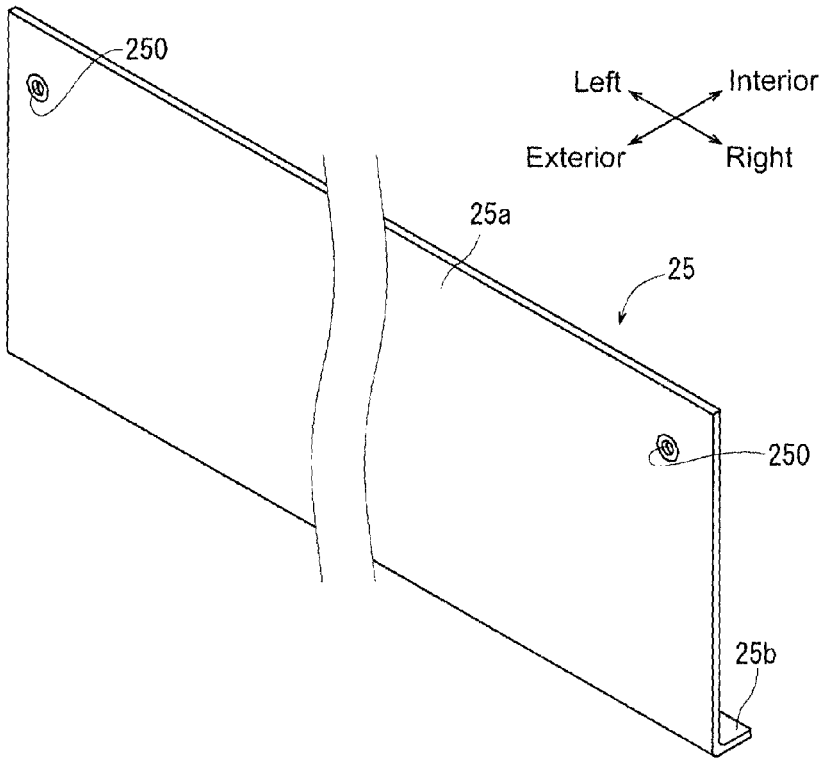
FIG. 4 is a perspective view of a supporting plate according to the outer wall structure of an embodiment.

As shown in FIG. 2, each of the outer wall mounting members 3 is composed of a single supporting plate 25 shown in FIG. 4 and at least one securing member 27 (e.g., two securing members) shown in FIG. 5. First, the components of the supporting plate 25 and the securing member 27 will be described in detail.

The supporting plate 25 shown in FIG. 4 includes a plate body 25*a* and a positioning portion 25*b*. The plate body 25*a* is formed of a metal plate extending from one end side (i.e., first end side) to the other end side (i.e., second end side) in the vertical direction and also extending in the left-right direction in FIG. 4, so the plate body 25*a* has the form of a rectangular plate. As shown in FIG. 2, the length of the plate body 25*a* in the left-right direction is set according to the length of the sash body 17*a* in the left-right direction. The length of the positioning portion 25*b* is almost same as the thickness of the horizontal furring strip member 11*b* in the interior-exterior direction that is horizontally perpendicular to the left-right direction in FIGS. 4, 6 and 7.

As shown in FIG. 4, the positioning portion 25*b* is formed by press-working the same metal plate as the plate body 25*a* formed. More specifically, the positioning portion 25*b* is formed integrally with the plate body 25*a* by bending the metal plate in the second end side of the plate body 25*a* at a substantially right angle toward the interior side of the building body 5. Consequently, the supporting plate 25 has a substantially L-shaped cross section in a direction orthogonal to the longitudinal direction. Note that the positioning portion 25*b* can be formed by bending the metal plate in the second end side of the plate body 25*a* at a substantially right angle toward the exterior side of the building body 5. In addition, the supporting plate 25 can be formed of a different material from the metal. The positioning portion 25*b* and the plate body 25*a* can be individual parts.

A plurality of first mounting holes 250 (e.g., two first mounting holes 250 in FIG. 4) are formed on the first end side of the plate body 25*a*. As shown in FIG. 6, each of the first mounting holes 250 is formed in the plate body 25*a* such that the plate body 25*a* is fixed to the horizontal furring strip member 11*b* and the frame member 9 at a position with a second distance L2 (i.e., a supporting-plate-fixing-position) away from the outer surface 172 of the sash body 17*a*.

Figure 5A:
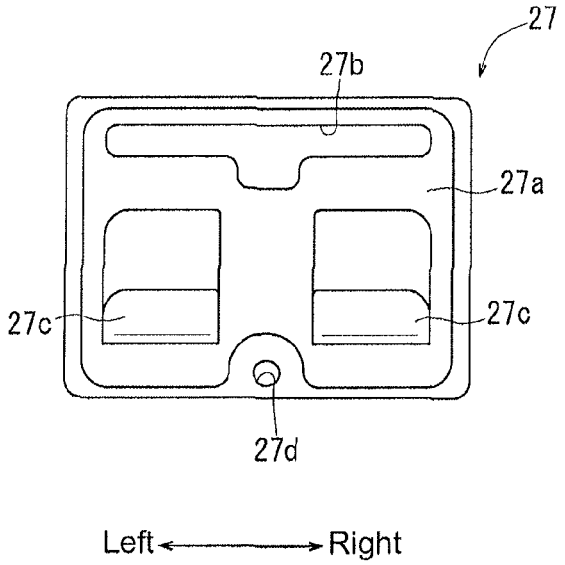
FIG. 5A is an enlarged front view of a securing member according to the outer wall structure of an embodiment.

As shown in FIG. 5, the securing member 27 has a substantially rectangular form. As shown in FIG. 5A, the securing member 27 is provided with a main body portion 27*a*, a rib 27*b*, a pair of securing portions 27*c*, and a second mounting hole 27*d* by subjecting a metal plate to punching and bending by press working.

Figure 5B:
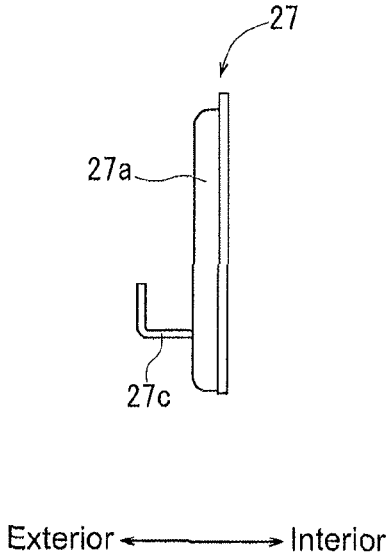
FIG. 5B is an enlarged side view of the securing member according to the outer wall structure of an embodiment.

As shown in FIG. 5B, the main body portion 27*a* has a form in which the central portion protrudes. As shown in FIG. 5A, the rib 27*b* is formed by providing a recess on one end side of the main body portion 27*a*. The securing portions 27*c* are located on the right side and the left side, respectively, of the main body portion 27*a*. Each of the securing portions 27*c* is formed by cutting out a tab surrounded by a substantially U-shaped slit from the main body portion 27*a*, bending the proximal end portion of the tab so as to stand at a substantially right angle from the main body portion 27*a*, and bending the distal end side portion of the tab at a substantially right angle to parallel the main body portion 27*a*. Consequently, as shown in FIG. 5B, the tab forms into the securing portion 27*c* having a substantially crank-like shape protruding from the main body portion 27*a*. As shown in FIG. 5A, the second mounting hole 27*d* is formed on the other end side of the main body portion 27*a* at substantially the center in the left-right direction. Note that the form of the securing portions 27*c* is designed as appropriate according to the thickness or the like of the exterior building material 7.

With this outer wall structure, after completion of the opening member mounting step, a supporting plate mounting step is performed in which the supporting plates 25 are mounted onto the building body 5, one each in the upside portion and the downside portion of the sash body 17*a*. In the following, a specific description of this step will be given based on the mounting of the supporting plate 25 onto the building body 5 in the upside portion of the sash body 17*a*.

As shown in FIG. 6, in the upside portion of the sash body 17*a*, the plate body 25*a* is fixed to the horizontal furring strip member 11*b* and the frame member 9 from the exterior side of the building body 5 by means of a first mounting screw 29 (i.e., a supporting-plate-fitting) inserted through the first mounting hole 250. At this time, the supporting plate 25 is positioned by bringing the positioning portion 25*b* into contact with the outer surface 172 of the sash body 17*a*. In this way, the plate body 25*a* is fixed to the horizontal furring strip member 11*b* and the frame member 9. Additionally, with the supporting plate 25, the end face of the positioning portion 25*b* comes into contact with the flange 17*b*. As described above, each of the first mounting holes 250 is formed in the plate body 25*a* at a position with the second distance L2 (i.e., a supporting-plate-fixing-position) away from the outer surface 172 of the sash body 17*a*. Consequently, the plate body 25*a* is fixed on the exterior side of the building body 5 at the supporting-plate-fixing-position away from the outer surface 172 of the sash body 17*a* by the second distance L2 by means of the first mounting screw 29. Note that the plate body 25*a* is fixed to the horizontal furring strip member 11*b* and the frame member 9 by another kind of a supporting-plate-fitting such as a nail in place of the first mounting screw 29.

Here, the supporting-plate-fixing-position with the second distance L2 is farther away from the outer surface 172 of the sash body 17*a* than the position with the above-described distance L from the outer surface 172. Accordingly, the plate body 25*a* is fixed to the horizontal furring strip member 11*b* and the frame member 9 at a position away from the sash body 17*a* than the distal end portion 173 of the flange 17*b*, in other words, at a position where the flange 17*b* is not present. The mounting of the supporting plate 25 onto the building body 5 in the upside portion of the sash body 17*a* is thus completed. The supporting plate 25 is also mounted onto the building body 5 in the downside portion of the sash body 17*a* by the same procedure. Thus, the supporting plate mounting step is completed.

Next, an exterior building material mounting step is performed in which a plurality of exterior building materials 7 are mounted onto the building body 5. To mount the exterior building materials 7 onto the building body 5, an engaging groove 7*a* (i.e., an engaging portion) is formed in an end face 70 of each of the exterior building materials 7. The distal end portion of each of the securing portions 27*c* of the securing members 27 is inserted into the engaging groove 7*a*. Then, in a state in which the distal end portion of the securing portions 27*c* is inserted into the engaging groove 7*a*, the securing members 27 are fixed to the plate body 25*a* of the supporting plate 25. Specifically, each securing member 27 is fixed to the plate body 25*a* by means of a second mounting screw 31 (i.e., a securing-member-fitting) inserted through the second mounting holes 27*d*. At this time, as described above, the end face of the positioning portion 25*b* is in contact with the flange 17*b*. Consequently, when the securing member 27 is fixed to the plate body 25*a* by means of the second mounting screw 31, it prevents the plate body 25*a* from being unstable, thus facilitating the fixation of the securing member 27 to the plate body 25*a*.

Here, the securing member 27 is fixed to the plate body 25*a* at a position with a third distance L3 (i.e., a securing-member-fixing-position) away from the outer surface 172 of the sash body 17*a*. As will be described later, the third distance L3 is a distance at which the interval from the end face 70 of the exterior building material 7 to the sash body 17*a* is about 10 mm to about 30 mm when each of the exterior building materials 7 has been mounted onto the building body 5 via the securing members 27. Also, the securing-member-fixing-position with the third distance L3 is closer to the sash body 17*a* than the position with the above-described distance L. That is, the securing-member-fixing-position with the third distance L3 is closest to the outer surface 172 among the positions with the first to third distances L1 to L3.

The securing members 27 are fixed to the plate body 25*a* in a state in which the securing portions 27*c* are oriented to the exterior side of the building body 5, and the distal end portions of the securing portions 27 are substantially vertically oriented and substantially parallel to the plate body 25*a*. Note that the number of the securing members 27 fixed to the plate body 25*a* is adjusted as appropriate according to the size of the opening portion 15, in other words, the length of the sash body 17*a* in the left-right direction.

Thus, as a result of the securing members 27 being fixed to the plate bodies 25*a*, the exterior building material 7 is mounted onto the building body 5 via the securing members 27 in the upside and downside of the sash body 17*a*, with the end face 70 of the exterior building material 7 being engaged to the securing portions 27*c*. On the right side and the left side of the sash body 17*a*, the exterior building materials 7 are mounted onto the building body 5 by means of known joint fittings (not shown). In this way, the exterior building materials 7 are mounted onto the building body 5, thus completing the exterior building material mounting step. With this outer wall structure, an interval of about 10 mm to about 30 mm is provided between the end face 70 of the exterior building material 7 and the sash body 17*a*, as described above. In addition, as a result of the exterior building materials 7 being mounted onto the building body 5 in this way, the supporting plates 25 are provided between the building body 5 and the exterior building materials 7 in the outer wall structure. Note that the screw head of the first mounting screw 29 is located on the inner side with respect to the exterior building material 7, thus the screw head is not exposed on the outer side of the exterior building material 7.

Here, as shown in FIG. 6, in this outer wall structure, the supporting-plate-fixing-position with the second distance L2 is farthest away from the sash body 17*a* among the positions with the first to third distances L1 to L3. Thus, the plate body 25*a* is fixed to the horizontal furring strip member 11*b* and the frame member 9 at the position farther away from the sash body 17*a* than the flange 17*b* and the securing members 27. Furthermore, since the plate body 25*a* is fixed to the horizontal furring strip member 11*b* and the frame member 9 from the exterior side of the building body 5, a space S corresponding to the thickness of the horizontal furring strip member 11*b* and the length of the positioning portion 25*b* is formed between the plate body 25*a* and the frame member 9. Also, the second mounting screw 31 is short as compared with the first mounting screw 29. Consequently, the distal end of the second mounting screw 31 is retained in the space S in a state in which the plate body 25*a* is fixed to the horizontal furring strip member 11*b* and the frame member 9. Thus, the distal end of the second mounting screw 31 is prevented from contacting not only with the flange 17*b*, but also with the waterproof sheet 13 nor the waterproof tape 21.

After completion of the exterior building material mounting step, a caulking compound filling step is performed in which the caulking compound 33 is filled between the end face 70 of the exterior building materials 7 and the sash body 17*a*. For applying the caulking compound 33, a back-up material 35 is provided in advance between the end face 70 of the exterior building material 7 and the sash body 17*a*, thus preventing the caulking compound 33 from being bonded to unnecessary locations such as the plate body 25*a*. Note that, in addition to filling with the caulking compound 33, a decorative member is provided between the exterior building materials 7 and the sash body 17*a* for shielding an area between the end face 70 of the exterior building material 7 and the sash body 17*a* to prevent the supporting plate 25 and the securing members 27 from being exposed on the exterior side of the building body 5. Thus, the installation of the outer wall structure is completed.

The outer wall structure installed in the above-described manner includes an outer wall mounting member 3. With the outer wall mounting member 3, the securing members 27 are fixed to the plate body 25*a*. Thus, by fixing the plate body 25*a* to the horizontal furring strip member 11*b* and the frame member 9 in the upside portion and the downside portion of the sash body 17*a* at the supporting-plate-fixing-position with the second distance L2 away from the outer surface 172 of the sash body 17*a*, it is possible to provide the securing members 27 in the upside portion and the downside portion of the sash body 17*a*, without directly fixing the securing members 27 to the building body 5. Then, by fixing the securing members 27 to the plate body 25*a* in a state in which the end face 70 of the exterior building material 7 being secured to the securing portions 27*c* by engaging insertion of the distal end portions of the securing portions 27*c* of the securing members 27, it is possible to mount the exterior building materials 7 onto the building body 5.

Here, the supporting-plate-fixing-position with the second distance L2 is farther away from the sash body 17*a* than the distal end portion 173 of the flange 17*b* with the distance L from the outer surface 172 of the sash body 17*a*. Thus, with this outer wall structure, the plate body 25*a* is fixed to the horizontal furring strip member 11*b* and the frame member 9 at the position different from the position of the flange 17*b*, in other words, at the position where the flange 17*b* is not present. At this time, the plate body 25*a* is fixed to the horizontal furring strip member 11*b* and the frame member 9 by means of the first mounting screw 29. Thus, as compared with a case where the fixation is achieved, for example, by attachment of an adhesion tape or bonding, it is possible to firmly fix the plate body 25*a* to the building body 5. Also, with the outer wall structure, it is not necessary to form a hole in the flange 17*b* in order to fix the plate body 25*a* to the horizontal furring strip member 11*b* and the frame member 9 by means of the first mounting screw 29. Consequently, with this outer wall structure, the waterproofness of the building 1 will not be reduced.

Since the plate body 25*a* and the flange 17*b* are fixed to the horizontal furring strip member 11*b* and the frame member 9 at positions different from each other in this way, the outer wall structure enables the plate body 25*a* to be firmly fixed to the horizontal furring strip member 11*b* and the frame member 9. Furthermore, with this outer wall structure, each of the securing members 27 is fixed to the plate body 25*a* by means of the second mounting screw 31. Thus, the securing members 27 are also firmly fixed to the plate body 25*a* as compared with a case where they are fixed, for example, by attachment of an adhesion tape or bonding. Also, when the securing members 27 are fixed to the plate body 25*a*, the distal end of the second mounting screw 31 is retained within the space S, and does not come into contact with the waterproof sheet 13, the waterproof tape 21, nor the flange 17*b*. Thus, with this outer wall structure, the securing members 27 are favorably fixed to the plate body 25*a*, without being affected by the presence of the waterproof sheet 13, the waterproof tape 21, and the flange 17*b*. As a result of these points, this outer wall structure enables the exterior building materials 7 to be stably mounted onto the building body 5.

With this outer wall structure, the securing members 27 are fixed to the plate body 25*a* at the securing-member-fixing-position with the third distance L3 away from the sash body 17*a*. Also, the securing-member-fixing-position with the third distance L3 is closer to the sash body 17*a* than the position with the above-described distance L, and is closest to the sash body 17*a* among the positions with the first to third distances L1 to L3. Thus, with this outer wall structure, the securing members 27 are provided close to the sash body 17*a* in the upside portion and the downside portion of the sash body 17*a*. Consequently, this outer wall structure can reduce the interval between the end face 70 of the exterior building materials 7 and the sash body 17*a* when the exterior building materials 7 are secured to the respective securing portions 27*c*. Specifically, the interval between the end face 70 of the exterior building material 7 and the sash body 17*a* is about 10 mm to about 30 mm. Accordingly, this outer wall structure enables the exterior building materials 7 to be disposed around and close to the window sash 17, thus reducing the area where the caulking compound 33 is to be filled.

Thus, with this outer wall structure, it is also possible to mount the exterior building materials 7 onto the building body 5 in the upside portion and the downside portion of the window sash 17, without directly fixing the exterior building materials 7 to the building body 5 by nailing or screwing.

Therefore, with the outer wall structure according to the embodiment, it is possible to mount the exterior building materials 7 onto the building body 5, while maintaining the waterproofness of the building 1, and preventing damage of the exterior building material 7 and deterioration in the aesthetic appearance of the building 1 in the upside portion and the downside portion of the window sash 17.

In particular, in this outer wall structure, the securing portions 27*c* secure the exterior building material 7 by their distal end portion being inserted into the engaging groove 7*a* formed in the end face 70 of the exterior building material 7. Thus, this outer wall structure enables the securing portions 27*c* to favorably secure the exterior building material 7 while reducing warping of the exterior building material 7 over time, without additional bonding or the like of the exterior building material 7 to the securing member 27, for example.

In addition, with this outer wall structure, the caulking compound filling step is performed after completion of the exterior building material mounting step. Here, in the building body 5, the waterproof sheet 13 is provided between the frame member 9 and the vertical and horizontal furring strip members 11*a*, 11*b*. In addition, the waterproof tape 21 is attached to the frame member 9 to which the flange 17*b* is fixed. Furthermore, as described above, in order to fix the plate body 25*a* to the horizontal furring strip member 11*b* and the frame member 9, no hole is formed in the flange 17*b*. As a result of these points, sufficient waterproofness is reliably provided for the building 1. Thus, as a result of the caulking compound 33 being filled between the exterior building materials 7 and the sash body 17*a* in the caulking compound filling step, this outer wall structure makes it possible to further improve the waterproofness of the building 1. In addition, the caulking compound 33 prevents the plate body 25*a* and the securing members 27 from being exposed on the exterior side of the building body 5, thus making it possible to further enhance the aesthetic appearance of the building 1.

Moreover, with this outer wall structure, the supporting plate 25 includes the plate body 25*a* and the positioning portion 25*b*. Thus, the outer wall structure facilitates the positioning of the supporting plate 25 relative to the sash body 17*a* and the building body 5. Hence, the outer wall structure enables the plate body 25*a* to be easily fixed to the building body 5. Furthermore, since the positioning portion 25*b* is formed by being bent from the plate body 25*a*, the positioning portion 25*b* is easily formed integrally with the plate body 25*a*.

Although the embodiment has been described above, the present invention is by no means limited to the above-described embodiment. Needless to say, modifications may be made as appropriate without departing from the scope and sprit of the invention.

For example, depending on the position with which the window sash 17 is provided to the building body 5, the outer wall mounting member 3 can be mounted onto the building body 5 only in the upside portion or the downside portion of the sash body 17*a*. This also applies to the case where an opening member other than the window sash 17 such as a door is provided to the building body 5.

To install this outer wall structure, after each of the plate bodies 25*a* has been fixed to the horizontal furring strip member 11*b* and the frame member 9, the securing members 27 are fixed to each of the plate bodies 25*a* of the supporting plates 25 in a state in which the securing portions 27*c* are inserted in the engaging groove 7*a*. Instead of this, the end face 70 of the exterior building material 7 can be secured to the securing portions 27*c* after the securing members 27 have been fixed to the plate bodies 25*a*. In the case of fixing the securing members 27 to the plate bodies 25*a* in advance in this way, the securing members 27 are fixed to each plate body 25*a* after the plate body 25*a* has been fixed to the horizontal furring strip member 11*b* and the frame member 9. Alternatively, the plate body 25*a* can be fixed to the horizontal furring strip member 11*b* and the frame member 9 in a state in which the securing members 27 are fixed to the plate body 25*a*.

Furthermore, the installation of the outer wall structure can be completed without performing the caulking compound filling step. Alternatively, after completion of the exterior building material mounting step, only a decorative member can be provided in the area between the exterior building material 7 and the sash body 17*a*, without performing the caulking compound filling step.

The positioning portion 25*b* can be provided with a sealant made from ethylene-propylene rubber (EPDM) or the like. In this case, by fixing the plate body 25*a* to the building body 5 while depositing the sealant on the outer surface 172 of the sash body 17*a*, the waterproof between the supporting plate 25 and the sash body 17*a* is provided with the sealant.

The embodiment is applicable to house buildings and various other buildings.

What is claimed is:

1. An outer wall mounting member mounting an exterior building material onto a building body having a flanged opening member fixed in the building body through a flange extending from an outer surface of the flanged opening member, the outer wall mounting member comprising:

a supporting plate comprising a horizontally extended positioning portion capable of being directly contacted with the outer surface of the flanged opening member, a vertical plate body connected at a first vertical end thereof to the horizontally extended positioning portion and a supporting-plate-fixing-position located in the vertical plate body at a vertical distance from the horizontally extended positioning portion that is greater than the width of the flange from the outer surface of the flanged opening member so that an optional supporting-plate-fitting located at the supporting-plate-fixing-position does not contact the flange of the flanged opening member; and an exterior-facing securing member having a securing portion to engage the exterior building material, the securing member configured to be fixed to the vertical plate body of the supporting plate, wherein the flanged opening member is a flanged opening sash member or a flanged door member.

2. The outer wall mounting member according to claim 1, wherein the exterior-facing securing member is capable of being fixed to the supporting plate by a securing-member-fitting whose distal end does not reach the flange of the flanged opening member.

3. The outer wall mounting member according to claim 1, wherein a first distance from the outer surface of the flanged opening member to a flange-fixing-position where the flange is fixed to the building body is shorter than a second distance from the outer surface of the flanged opening member to the supporting-plate-fixing-position.

4. The outer wall mounting member according to claim 3, wherein the second distance is greater than the width of the flange extending from the outer surface of the flanged opening member.

5. The outer wall mounting member according to claim 2, wherein a third distance from the outer surface of the flanged opening member to a securing-member-fixing-position where the securing-member-fitting fixes the exterior-facing securing member to the supporting plate is shorter than a distance from the outer surface of the flanged opening member to the exterior building material when the exterior building material is mounted onto the building body.

6. The outer wall mounting member according to claim 2, wherein the securing-member-fitting is at least one member selected from the group consisting of a screw and a nail.

7. The outer wall mounting member according to claim 2, wherein the horizontally extended positioning portion is configured to position the vertical plate body relative to the flange of the flanged opening member with a predetermined distance to keep the distal end of the securing-member-fitting from contacting with the flange.

8. The outer wall mounting member according to claim 1, wherein the vertical plate body and the horizontally extended positioning portion are integrally formed by deforming a plate.

9. The outer wall mounting member according to claim 2, wherein the supporting plate forms a space between the flange of the flanged opening member and the vertical plate body when the supporting plate is attached to the building body.

10. The outer wall mounting member according to claim 9, wherein the horizontally extended positioning portion is a plate configured to position the horizontally extended positioning portion relative to the flange of the flanged opening member with forming the space to keep the distal end of the securing-member-fitting from contacting with the flange.

11. The outer wall mounting member according to claim 10, wherein the vertical plate body and the horizontally extended positioning portion are integrally formed by deforming a plate.

12. The outer wall mounting member according to claim 1, wherein the flange of the flanged opening member is covered with a waterproof material when the flange is fixed to the building body.

13. The outer wall mounting member according to claim 12, wherein the waterproof material is at least one material selected from the group consisting of a waterproof sheet and a waterproof tape.

14. The outer wall mounting member according to claim 1, wherein the supporting-plate-fitting is at least one of a screw and a nail.

15. The outer wall mounting member according to claim 1, wherein the vertical plate body is made of a metal.

16. The outer wall mounting member according to claim 1, wherein the exterior-facing securing member is fixed to the vertical plate body before the supporting plate is attached to the building body.

17. The outer wall mounting member according to claim 1, wherein the exterior building material is made from a ceramic.

18. An outer wall structure comprising:

a building body;

a flanged opening member having a flange extending from an outer surface of the flanged opening member, the flanged opening member is fixed in the building body through the flange, wherein the flanged opening member is a flanged opening sash member or a flanged door member;

an exterior building material;

an outer wall mounting member for mounting the exterior building material onto the building body, wherein the outer wall mounting member comprises:

a supporting plate comprising a horizontally extended positioning portion capable of being directly contacted with the outer surface of the flanged opening member, a vertical plate body connected at a first vertical end thereof to the horizontally extended positioning portion, and a supporting-plate-fixing-position located in the vertical plate body at a vertical distance from the horizontally extended positioning portion that is greater than the width of the flange from the outer surface of the flanged opening member so that a supporting-plate-fitting located at the supporting-plate-fixing-position does not contact the flange of the flanged opening member; and an exterior-facing securing member having a securing portion to engage the exterior building material, the securing member configured to be fixed to the vertical plate body of the supporting plate, and the outer wall mounting member is disposed so that i) the horizontally extended positioning portion is contacted with the outer surface of the flanged opening member, ii) the vertical plate body is fixed to the building body by the supporting-plate-fitting at the supporting-plate-fixing-position, iii) the exterior-facing securing member is fixed to the vertical plate body of the supporting plate, and iv) the exterior building material is engaged to the securing portion of the securing member such that the exterior building material is fixed on the building body.

19. The outer wall mounting member according to claim 1, wherein the exterior building material has an engaging groove so that the securing portion of the exterior-facing securing member are engaged with the engaging groove of the exterior building material to fix the exterior building material to the outer wall mounting member.

20. The outer wall structure according to claim 18, wherein the exterior building material has an engaging groove, and the securing portion of the exterior-facing securing member are engaged with the engaging groove of the exterior building material so that the exterior building material is fixed to the outer wall mounting member.

* * * * *